US009711045B1

(12) United States Patent
Worthy et al.

(10) Patent No.: US 9,711,045 B1
(45) Date of Patent: Jul. 18, 2017

(54) SYSTEM AND METHOD FOR TRAFFIC PREEMPTION EMITTER TYPE DETECTION AND RESPONSE

(71) Applicant: Tomar Electronics, Inc., Gilbert, AZ (US)

(72) Inventors: David G. Worthy, Gilbert, AZ (US); Timothy A. Geiger, Gilbert, AZ (US)

(73) Assignee: TOMAR ELECTRONICS, INC., Gilbert, AZ (US)

( * ) Notice: Subject to any disclaimer, the term of this patent is extended or adjusted under 35 U.S.C. 154(b) by 0 days.

(21) Appl. No.: 14/798,244

(22) Filed: Jul. 13, 2015

Related U.S. Application Data

(60) Provisional application No. 62/024,187, filed on Jul. 14, 2014.

(51) Int. Cl.
*G08G 1/087* (2006.01)

(52) U.S. Cl.
CPC ..... *G08G 1/087* (2013.01)

(58) Field of Classification Search
CPC ..... G08G 1/087
USPC ..... 340/902, 906
See application file for complete search history.

(56) References Cited

U.S. PATENT DOCUMENTS

| | | | |
|---|---|---|---|
| 5,172,113 | A | 12/1992 | Hamer |
| 5,187,373 | A | 2/1993 | Gregori |
| 5,187,476 | A | 2/1993 | Hamer |
| 5,202,683 | A | 4/1993 | Hamer et al. |
| 5,539,398 | A | 7/1996 | Hall et al. |
| 5,602,739 | A | 2/1997 | Haagenstad et al. |
| 5,955,968 | A | 9/1999 | Bentrott et al. |
| 6,326,903 | B1 | 12/2001 | Gross et al. |
| 6,888,474 | B2 | 5/2005 | Sharp et al. |
| 7,042,345 | B2 | 5/2006 | Ellis |
| 7,248,183 | B2 | 7/2007 | Pfleging et al. |
| 7,307,547 | B2 | 12/2007 | Schwartz |
| 7,333,028 | B2 | 2/2008 | Schwartz |
| 7,573,399 | B2 | 8/2009 | Schwartz |
| 7,952,491 | B2 | 5/2011 | Schwartz et al. |
| 8,031,062 | B2 | 10/2011 | Smith |
| 8,054,202 | B1 | 11/2011 | Sikora et al. |
| 8,072,346 | B2 | 12/2011 | Hall et al. |

(Continued)

FOREIGN PATENT DOCUMENTS

| | | |
|---|---|---|
| EP | 0531045 | 3/1993 |

OTHER PUBLICATIONS

Kamalanathsharma. Traffic Adaptive Offset-Based Preemption for Emergency Vehicles. 2010 http://filebox.vt.edu/users/rkishore/pdf/thesis2010.pdf.

*Primary Examiner* — Brent Swarthout
(74) *Attorney, Agent, or Firm* — Booth Udall Fuller, PLC

(57) ABSTRACT

A traffic preemption system comprising a vehicle preemption unit configured to mount to a vehicle and transmit a signal comprising one or more identifying pulses, a detection unit configured to, receive the signal transmitted by the vehicle preemption unit, identify a characteristic of the vehicle preemption unit using the one or more identifying pulses, and calculate a timing delay based on the identified characteristic of the vehicle preemption unit, and an intersection preemption unit configured to receive the timing delay from the detection unit and change a traffic light in response to the timing delay.

25 Claims, 6 Drawing Sheets

(56) References Cited

U.S. PATENT DOCUMENTS

| | | | | |
|---|---|---|---|---|
| 2006/0273923 | A1* | 12/2006 | Schwartz | G08G 1/0965 340/906 |
| 2008/0094249 | A1* | 4/2008 | Pappas | G08G 1/087 340/906 |
| 2011/0084853 | A1 | 4/2011 | Johnson | |
| 2011/0084854 | A1 | 4/2011 | Johnson | |
| 2011/0109477 | A1 | 5/2011 | Edwardson et al. | |
| 2011/0169661 | A1 | 7/2011 | Eichhorst | |
| 2011/0193722 | A1 | 8/2011 | Johnson | |
| 2011/0234423 | A1 | 9/2011 | Edwardson | |
| 2011/0304476 | A1 | 12/2011 | Johnson et al. | |
| 2014/0125498 | A1* | 5/2014 | Curry | G08G 1/087 340/906 |

* cited by examiner

SYSTEM AND METHOD FOR TRAFFIC PREEMPTION EMITTER TYPE DETECTION AND RESPONSE

CROSS REFERENCE TO RELATED APPLICATIONS

This application claims priority to U.S. Provisional Application No. 62/024,187 entitled "System and Method for Traffic Preemption Emitter Type Detection and Response" to David Worthy, filed on Jul. 14, 2014, the contents of which is hereby incorporated by reference in its entirety.

BACKGROUND

1. Technical Field

Aspects of this document relate generally to traffic preemption systems.

2. Background Art

Traffic preemption systems are conventionally used to permit emergency and other vehicles to change a traffic light initially red at an intersection to green prior to their arrival. With the light in the vehicle's favor, the vehicle does not need to wait or to drive on the wrong side of the street to avoid stopped vehicles at the light. In addition, conventional traffic preemption systems have been used to aid public transportation vehicles, such as buses, to maintain headway relative to other vehicles during high traffic periods.

Currently, there are a variety of manufacturers that produce traffic preemption equipment. As such, emergency vehicles may be equipped with a vehicle preemption unit that may made by a different manufacturer than that of the intersection preemption unit, detector unit, etc. that is installed at a traffic intersection. This may result in inaccurate timing of traffic light preemption due to variances in signal strength, type of preemption signal emitter in the vehicle preemption unit, and other characteristics that may vary by manufacturer and equipment model.

SUMMARY

Implementations of a traffic preemption system may comprise a vehicle preemption unit configured to mount to a vehicle and transmit a signal comprising one or more identifying pulses, a detection unit configured to receive the signal transmitted by the vehicle preemption unit, identify a characteristic of the vehicle preemption unit using the one or more identifying pulses, and calculate a timing delay based on the identified characteristic of the vehicle preemption unit, and an intersection preemption unit configured to receive the timing delay from the detection unit and change a traffic light in response to the timing delay.

Particular implementations may comprise one or more of the following features. The vehicle preemption unit may comprise at least one of a strobe emitter and an LED emitter. The one or more identifying pulses may comprise a pulse pattern. The characteristic of the vehicle preemption unit identified may comprise a type of vehicle preemption unit. The characteristic of the vehicle preemption unit identified may comprise a manufacturer of the vehicle preemption unit. The vehicle preemption unit may be further configured to transmit a predetermined pulse pattern based on a priori information about a characteristic of the vehicle preemption unit. The vehicle preemption unit may further comprise an output signal power detector configured to measure the signal strength of the signal transmitted by the vehicle preemption unit. The characteristic of the vehicle preemption unit identified may comprise the signal strength of the signal transmitted by the vehicle preemption unit.

Implementations of a traffic preemption system may comprise a vehicle preemption unit configured to mount to a vehicle and transmit a signal comprising one or more identifying pulses, a detection unit configured to receive the signal transmitted by the vehicle preemption unit, identify a characteristic of the vehicle preemption unit using the one or more identifying pulses and calculate a trip point based on the identified characteristic of the vehicle preemption unit and an estimated speed of the vehicle, and an intersection preemption unit configured to receive the trip point from the detection unit and change a traffic light in response to the trip point received.

Particular implementations may comprise one or more of the following features. The detection unit may be further configured to determine an amplitude of the signal transmitted by the vehicle preemption unit by sampling the incoming signal and determining an average pulse amplitude or by determining a width of a detection envelope for the incoming signal. The characteristic of the vehicle preemption unit identified may comprise a type of vehicle preemption unit. The characteristic of the vehicle preemption unit identified may comprise a manufacturer of the vehicle preemption unit. The detection unit may be further configured to normalize a pulse amplitude of the signal received from the vehicle preemption unit based on the characteristic of the vehicle preemption unit that is identified. The vehicle preemption unit may further comprise an output signal power detector configured to measure the signal strength of the signal transmitted by the vehicle preemption unit. The characteristic of the vehicle preemption unit identified may comprise the signal strength of the signal transmitted by the vehicle preemption unit. The vehicle preemption unit may be further configured to transmit a suppression signal to the detection unit and the intersection preemption unit is further configured to prevent a change in a traffic light in response to the suppression signal received from the detection unit.

Implementations of a traffic preemption method may comprise transmitting a signal comprising one or more identifying pulses by a vehicle preemption unit mounted to a vehicle, receiving the signal by a detection unit, identifying, by the detection unit, a characteristic of the vehicle preemption unit using the one or more identifying pulses, adjusting, by the detection unit, an amplitude of a signal output by the detection unit based on the identified characteristic of the vehicle preemption unit, receiving, by an intersection preemption unit, the amplitude-adjusted signal output from the detection unit, and changing, by the intersection preemption unit, a traffic light in response to the amplitude-adjusted signal received by the intersection preemption unit.

Particular implementations may comprise one or more of the following features. The one or more identifying pulses may comprise a pulse pattern. The method may further comprise determining, by the detection unit, an amplitude of the signal transmitted by the vehicle preemption unit by sampling the incoming signal and determining an average pulse amplitude or by determining a width of a detection envelope for the incoming signal. The characteristic of the vehicle preemption unit identified may comprise a type of vehicle preemption unit. The characteristic of the vehicle preemption unit identified may comprise a manufacturer of the vehicle preemption unit. The method may further comprise normalizing a pulse amplitude of the signal received from the vehicle preemption unit based on the characteristic of the vehicle preemption unit that is identified. The method may further comprise transmitting, by the vehicle preemption unit, a predetermined pulse pattern based on a priori information about a characteristic of the vehicle preemption unit. The method may further comprise measuring, by an output signal power detector of the vehicle preemption unit, a signal strength of the signal transmitted by the vehicle preemption unit. The characteristic of the vehicle preemption unit identified may comprise the signal strength of the signal transmitted by the vehicle preemption unit.

Aspects and applications of the disclosure presented here are described below in the drawings and detailed description. Unless specifically noted, it is intended that the words and phrases in the specification and the claims, if included, be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶6. Thus, the use of the words "function," "means" or "step" in the Description, Drawings, or Claims is not intended to somehow indicate a desire to invoke the special provisions of 35 U.S.C. §112, ¶6, to define the invention. To the contrary, if the provisions of 35 U.S.C. §112, ¶6 are sought to be invoked to define the claimed disclosure, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶6. Moreover, even if the provisions of 35 U.S.C. §112, ¶6 are invoked to define the claimed disclosure, it is intended that the disclosure not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DESCRIPTION and DRAWINGS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended traffic preemption system and/or assembly procedures for a traffic preemption system will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such traffic preemption systems and implementing components, consistent with the intended operation.

Conventional traffic preemption detection units detect pulses of electromagnetic radiation, such as light, emitted by vehicle preemption units. These light or other pulses are then converted to electrical pulses, filtered, and conditioned, and sent to an intersection preemption unit for further processing. The electrical pulses represent amplitude and timing information presented by the vehicle preemption unit's emitter. The intersection preemption unit then uses the amplitude and timing between the electrical pulses to determine additional information, such as, for example, pulse to pulse timing for indication of a valid preemption request and/or type of preemption request, additional pulses or pulse to pulse variation indicating vehicle identification information and priority level, authentication, number of approaching vehicle, amplitude indicating distance of vehicle(s) to intersection, speed of vehicle based on rate of change in signal amplitude, and/or trip point based on preprogrammed information stored in the preemption unit.

Implementations of the systems and methods described in the present disclosure may focus on pulse to pulse timing, the addition of extra pulses, and pulse to pulse variation to determine the type and/or manufacturer of the vehicle preemption unit that has emitted a traffic preemption signal and using this information to calculate a timing delay or trip point or to adjust the amplitude of electrical pulses produced by the detection unit that are sent to the intersection preemption unit thereby preventing the need to modify existing intersection preemption units to accommodate different types and/or manufacturers of related preemption equipment.

Figure 1:
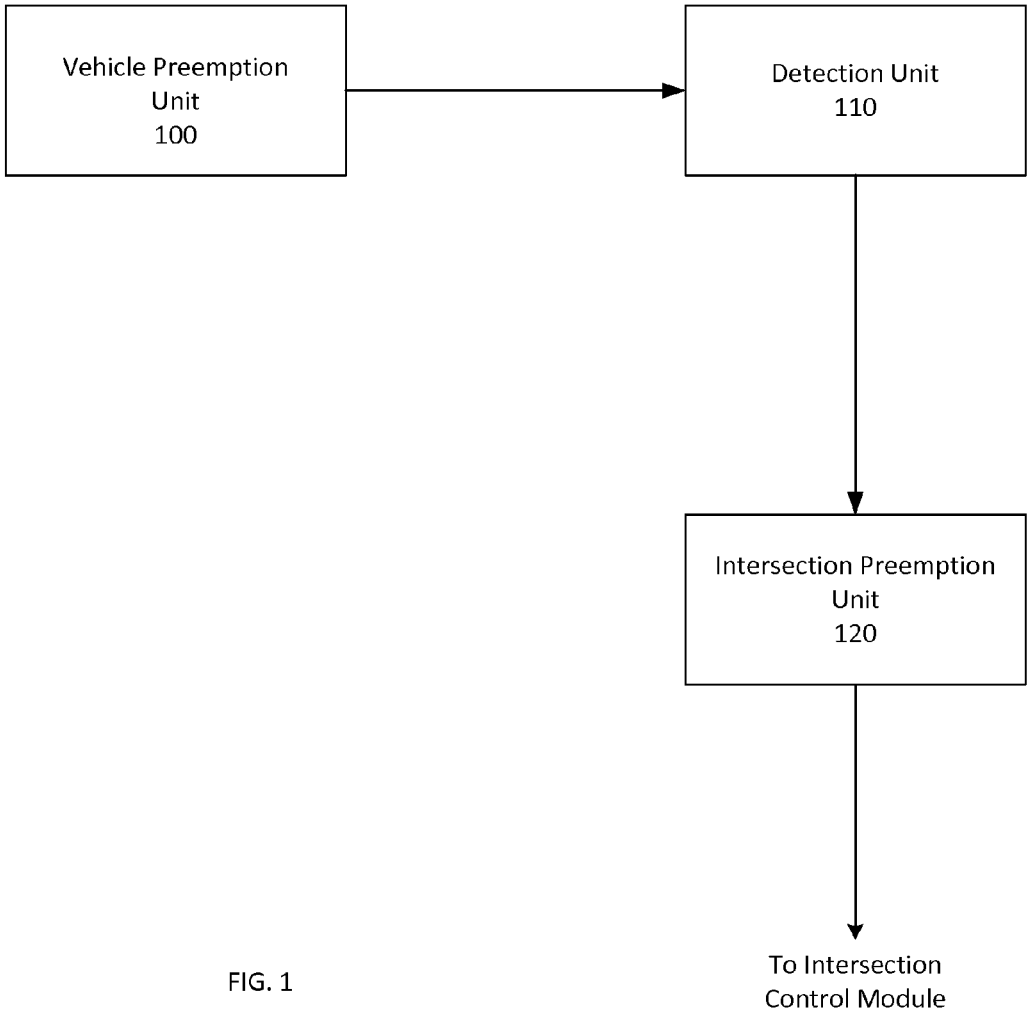
FIG. 1 is a block diagram of an implementation of a traffic preemption system.

Referring to FIG. 1, a block diagram of the basic components of an implementation of a traffic preemption system is illustrated. As shown, the system 100 comprises a vehicle preemption unit 100, which is configured to be mounted to a vehicle. The vehicle may be any vehicle designed for terrestrial, aero, or aquatic travel, and in particular implementations may more commonly comprise an emergency vehicle, such as, but not limited to a police car, fire engine, ambulance, or a high priority non-emergency vehicle, such as a city transit vehicle or a dignitary vehicle. The vehicle preemption unit 100 is designed with one or more signal emitters configured to emit a preemption signal that may be detected by a detection unit 110 located at a traffic intersection. The one or more signal emitters may emit a radio frequency (RF), optical, infrared, or other electromagnetic signal. The detection unit 110 then communicates with an intersection preemption unit 120, which transmits a signal to the intersection control module that ultimately sends a control signal to the traffic light and/or related equipment to change the traffic signal at an appropriately determined time.

Figure 2:
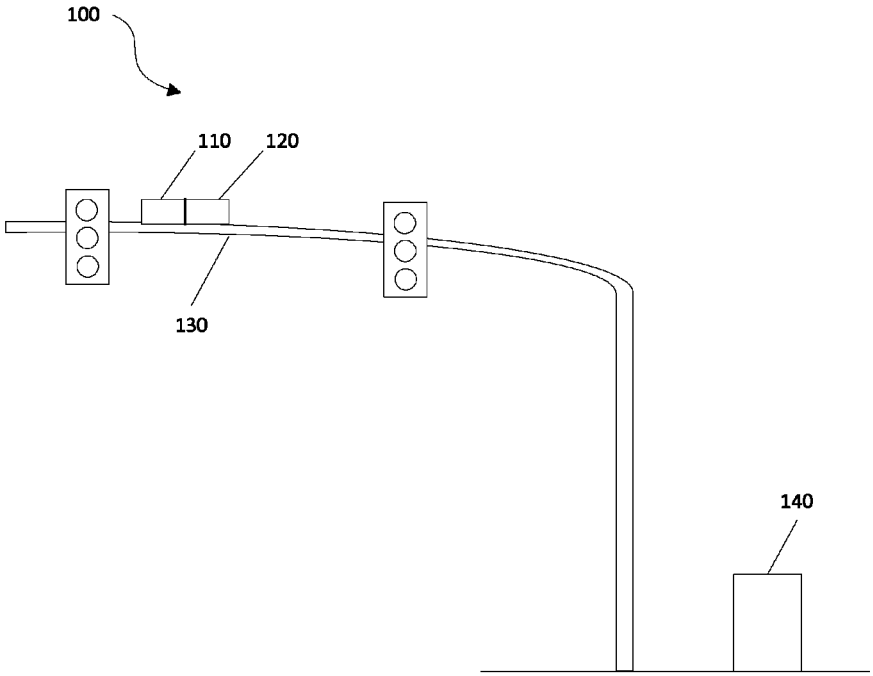
FIG. 2 shows an implementation of a traffic preemption system located at a traffic intersection.

FIG. 2 depicts an implementation of a traffic preemption system as commonly located at a traffic intersection. As shown, the intersection preemption unit 120 may also comprise the detection unit 110 in some implementations and in other implementations, these two components 110, 120 may be discrete components located separately on traffic light support 130, or may be combined into a single component. The intersection preemption unit 120 is configured to provide power and communicate with the intersection control module 140 as well as other electronic devices that may also comprise the traffic preemption system. Detection unit 110 is configured to receive radio, optical, or other signals transmitted from a vehicle preemption unit mounted to an emergency or other vehicle and to communicate with the intersection preemption unit 120.

As there are many different manufacturers of traffic preemption system equipment, it is often the case that the vehicle preemption unit mounted to a vehicle may be made by a different manufacturer or be of a different type of equipment than that of the detection unit or intersection preemption unit. Accordingly, there may be difficulty in a current systems' ability to properly time the changing of a traffic signal in response to detecting a preemption signal emitted by a vehicle preemption unit due to incompatibilities in the various components of the system. This may be a result of a detection unit's improper identification of or inability to identify a type (e.g. strobe, infrared light emitting diode (LED), laser, etc.), manufacturer, signal strength, or other relevant characteristic of a signal emitter used by a vehicle preemption unit. As one of ordinary skill in the art would recognize, due to these different characteristics, vehicle preemption unit signal emitters may have different output power levels that correspond to different ranges at which traffic preemption may be triggered. Implementations of the systems and methods disclosed herein are directed toward improving the accuracy and timing of traffic preemption response by adjusting preemption timing to account for the various differences in vehicle preemption unit signal emitter characteristics.

Different types of vehicle preemption unit signal emitters may emit a signal or pulse pattern that is distinct to that particular type or manufacturer of the device. For example, a manufacturer of a particular brand of strobe emitters may inject extra pulses in the communication signal pattern emitted by the vehicle preemption unit that result in a signal pulse pattern that is unique to that manufacturer or product line. As another example, a particular manufacturer may configure the LED emitter of their vehicle preemption units to pulse in a different pattern (e.g. a series of rapid succession pulses rather than a standard single pulse) that is unique to that manufacturer's LED emitters. A manufacturer may also set the signal strength of the signal emitted by their vehicle preemption unit at a predefined level that distinguishes it from other manufacturer's products. Accordingly, by utilizing this information on the detection side, the detection and/or intersection preemption unit is able to more accurately predict the time at which an emergency vehicle will approach an intersection and appropriately adjust the timing of preemption of the traffic signal.

Figure 3:
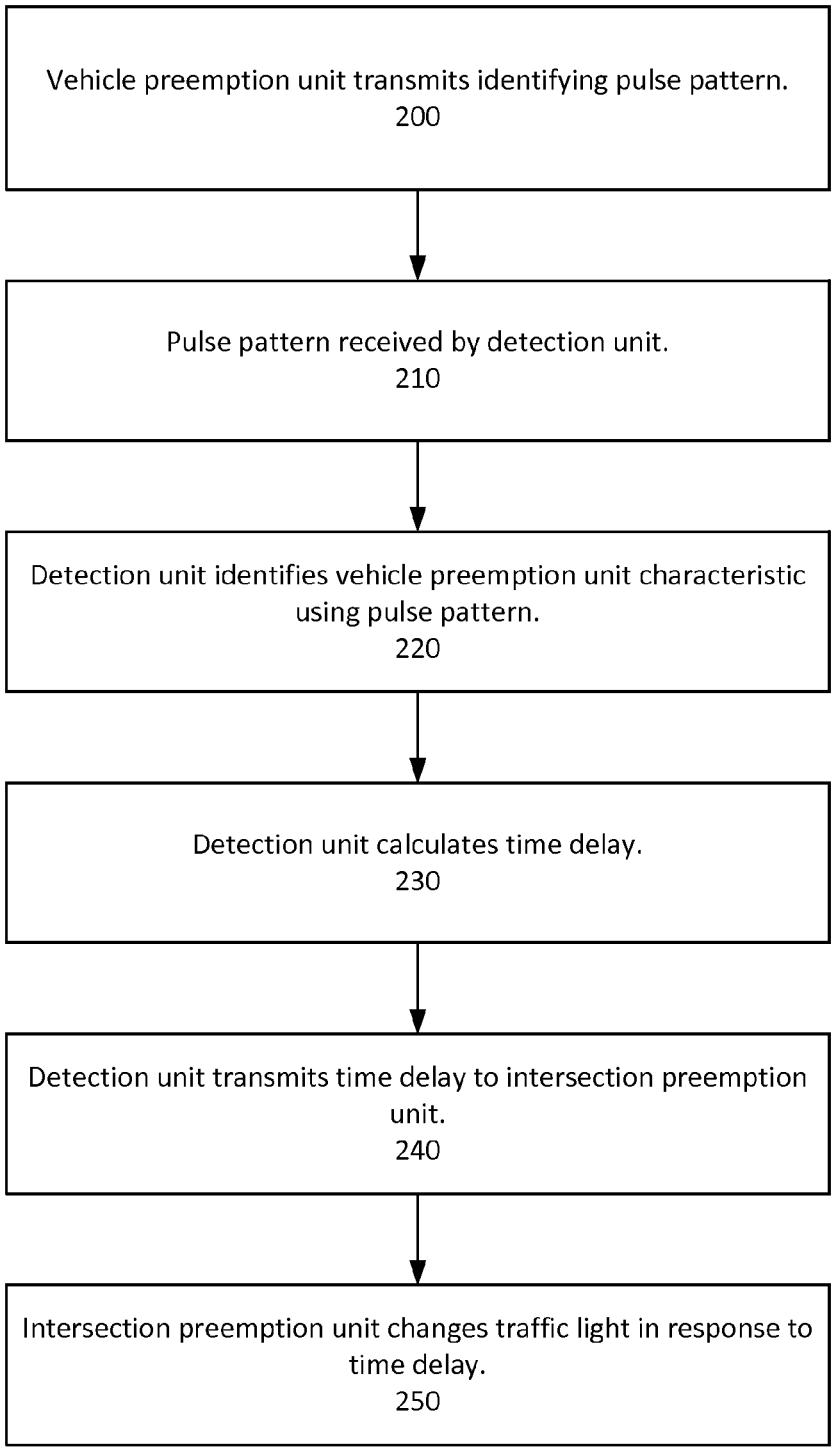
FIGS. 3-4 are block diagrams of implementations of methods of traffic preemption.

FIG. 3 provides a block diagram of an implementation of a method of traffic preemption in which a signal emitter of a vehicle preemption unit emits a pulse pattern within the communication signal that provides some item of identifying information 200 as to at least one characteristic of the vehicle preemption unit such as, for example, the type of emitter or vehicle preemption unit, manufacturer, or output signal strength. The communication signal having the pulse pattern is then received by the detection unit 210 located at a traffic intersection and the detection unit then utilizes the pulse pattern to determine the identifying information that is present within 220. A time delay is then calculated by the detection unit or other processing unit within the system 240 which equates to the length of time that the system should wait prior to sending a control signal to the intersection control module to change the traffic light based on the estimated location and rate of travel of the vehicle to which the vehicle preemption unit is mounted. When an amount of time equal to the time delay has elapsed, the intersection preemption unit then sends a control signal to the intersection control module 250, which triggers a change in the traffic light.

Alternatively, in some embodiments, the detection unit does not calculate a timing delay or advance, but instead adjusts an amplitude of the signal that is sent to the intersection preemption unit based on the type of emitter that is detected by the detection unit. The response of the intersection preemption unit resulting from the signal received from the detection unit is thus, equalized in the sense that the distance or trip point at which the intersection preemption unit requests preemption from the intersection control module is the same regardless of the manufacturer or type of vehicle preemption unit detected.

For example, when a detection unit is in a default state, without further information, the detection unit treats all signals received as if they were emitted by a default manufacturer and are of a default type. If the detection unit determines that the signal received is from a different type or manufacturer than the default type or manufacturer, the detection unit adjusts the output signal strength of the signal the detection unit sends to the intersection preemption unit. As a more specific example, assume that the detection unit is configured to recognize signals received from a Tomar 3060 strobe emitter. When the detection unit receives a signal from an Opticom strobe emitter, the detection unit determines this information and increases the amplitude of the signal sent by the detection unit to the intersection preemption unit by one third to account for the fact that the Opticom strobe emitter has a signal strength that is only two thirds that of the Tomar 3060 strobe emitter. As a result, the intersection preemption unit then requests preemption by sending a signal to the intersection control module when the vehicle equipped with either the Tomar 3060 or Opticom strobe emitter is at the same distance from the intersection.

Figure 4:
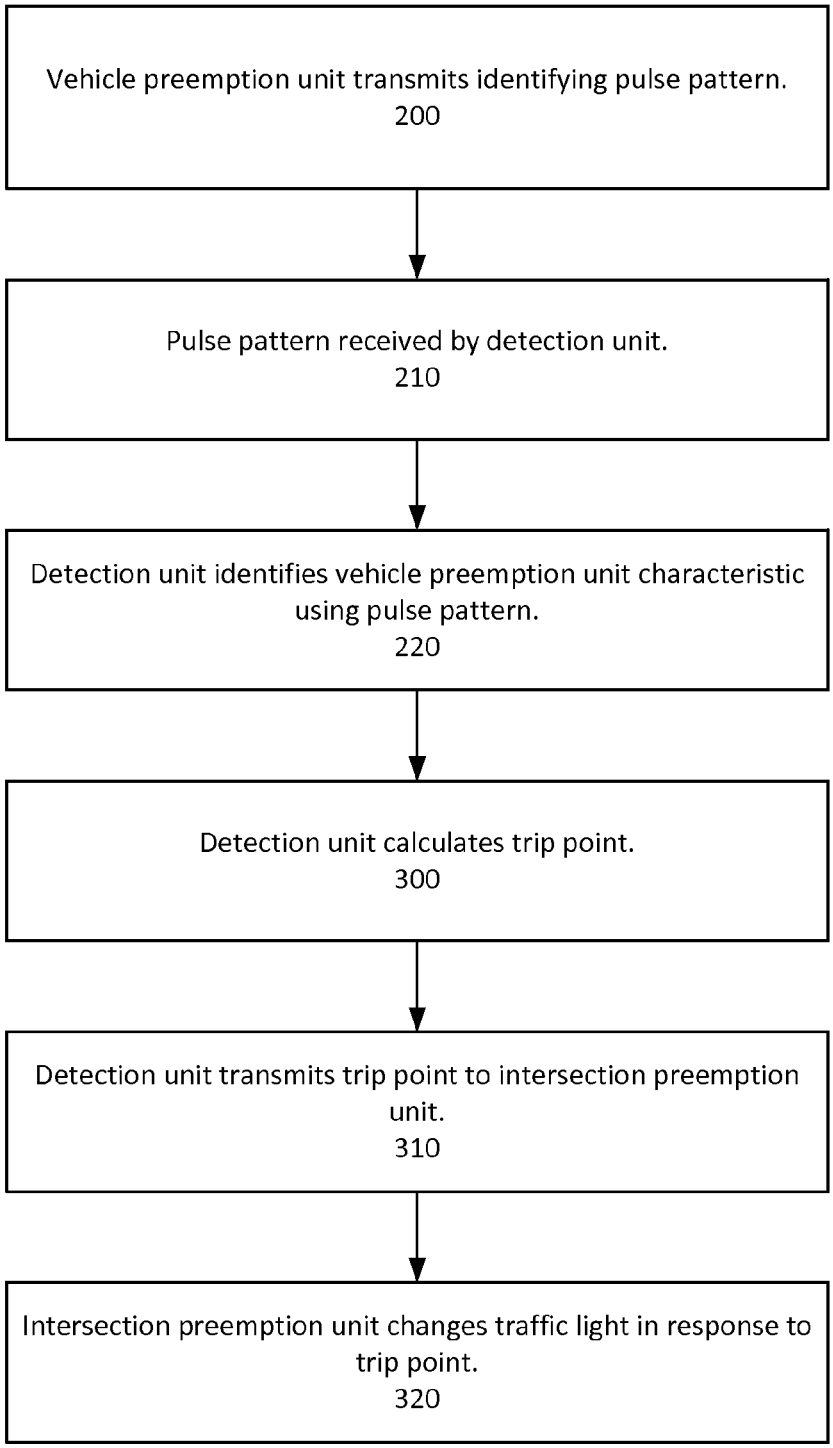

Additionally, FIG. 4 provides a block diagram of an implementation of a method of traffic preemption in which upon detecting the pulse pattern that provides identifying information as to at least one characteristic of the vehicle preemption unit 220, the detection unit calculates a trip point, which is known to one of ordinary skill in the art as the point at which the traffic light should change based on the anticipated location of the vehicle to which the vehicle preemption unit is mounted. The detection unit then transmits the trip point to the intersection preemption unit 310, which then sends a control signal to the intersection control module at the appropriate point at which the traffic light should be changed 320.

The timing delay or trip point may be calculated based on the identifying characteristic of the vehicle preemption unit received from the pulse pattern as detected by the detection unit in addition to information received from a controller area network (CAN) bus, a vehicle's odometer, or GPS location equipment to estimate a vehicle's estimated time of arrival (ETA) at an intersection. Additionally, the information contained in the pulse pattern emitted by the vehicle preemption unit may also trigger a suppression of traffic signal preemption, meaning that no change to the intersection's traffic light occurs.

In some implementations of the system and methods disclosed herein, additional or otherwise meaningful pulses may be purposefully injected into the communications signal sent by the vehicle preemption unit so that the type, manufacturer, signal strength, or other identifying information may be easily recognized by the detection unit. This information may be programmed into the vehicle preemption unit based on predefined or a priori information known about the characteristics of the vehicle preemption unit. Alternatively, the vehicle preemption unit may further comprise an output signal power detector that may be used to measure the signal strength of the communications signal emitted by the vehicle preemption unit to account for varying signal strength. For example, strobe emitters tend to lose signal strength as the emitter ages or there is an increase in temperature. By acquiring an accurate reading of actual output signal strength and then embedding that information into the pulse pattern of the communications signal being sent by the vehicle preemption unit, the accuracy of the timing of traffic preemption may be improved to result in a traffic signal being changed at the appropriate time relative to the vehicle's approach of the intersection.

Other characteristics of the communications signal emitted by the vehicle preemption unit may also be used to convey information to the detection unit and/or intersection preemption unit. For example, a laser emitter may be configured to allow for variation in pulse width and/or amplitude, which may convey information related to a vehicle's speed, position, or any other relevant information. A widening pulse, for example, may indicate an increase in the vehicle's speed whereas a narrowing pulse width may indicate slowing of the vehicle.

In some implementations that utilize newer detector technology with a microcontroller to process incoming optical pulse detections and produce an output waveform, it is possible to analyze the incoming pulse detections and produce output waveforms based on one or more properties of these optical signals. For example, the pulses emitted by typical strobe emitters may vary greatly in characteristics from pulses emitted by an LED emitter. Pulses produced by an LED emitter may be at lower amplitude signals when compared to a strobe emitter. Each emitter manufacturer may set the detector to transmit a series of pulses to promote the inherent properties of that manufacturer's detector circuitry and thus, differentiation between types or manufacturers of emitter equipment may be rather straightforward. At any given distance, the apparent signal amplitude as seen at the intersection is different for a strobe emitter and an LED emitter; however, the detector is able to discern the emitter type and modify the output waveform based on this information. This allows the detector to equalize the output waveforms such that both emitter types result in similar decoded amplitudes at most or all detectable distances.

In some implementations, the final amplitude determination and thus, range, may be performed at the intersection processing unit. At this point, the amplitude is simply a form of averaging across all incoming pulses. In order for various emitter types to properly represent a similar range value, the pulse amplitude average for each type is preferably similar, though this is not required.

Different detector embodiments may obtain the pulse amplitudes using different methodologies. For example, in one embodiment, the pulse amplitudes are directly obtained by sampling the signal. With an LED emitter, each pulse in the series is factored into the final pulse amplitude determination as a component of an average value. At a given distance, a strobe emitter may result in an average amplitude of 3.4 units, for example, and an LED emitter may result in an average of 2.6 units of amplitude. In other embodiments, the detector may determine the pulse amplitude from the width of the detection envelope. This envelope width may be larger for an LED emitter due to the series of pulses. Regardless of which embodiment is utilized, it is intended that the detector outputs be modified such that all or most emitters at a specific range appear equal as a result of the pulse amplitude averaging.

Normalizing the amplitude of pulses emitted across emitter types to the same range curve begins with identifying emitter types. While this disclosure focuses on LED and strobe emitters, it is intended that the same methodology may be applied to other emitter types. Strobe emitters emit a single pulse versus a burst of four pulses by the LED emitter.

In order to differentiate between the two emitter types, the detector triggers off the first pulse and detects any of the bursts in the LED emitter type. This first pulse contains the timing information and the initial amplitude information. For an LED emitter, successive pulses in the series are used primarily for amplitude modifications to meet the range normalization goals.

Using the example of a strobe emitter and LED emitter, the strobe emitter is used as a baseline for the range curve. This is primarily due to the strobe having only a single pulse output. In some implementations, the incoming pulse amplitudes may be sampled and mapped to a corresponding output waveform curve. It should be noted that this curve can be of any desired shape, but may typically be at least monotonic. A secondary curve is then used for the LED emitter to modify the output waveform upon detection of any bursts following the initial pulse. This curve is the one that maps the LED range onto that of a strobe emitter.

Figure 5:
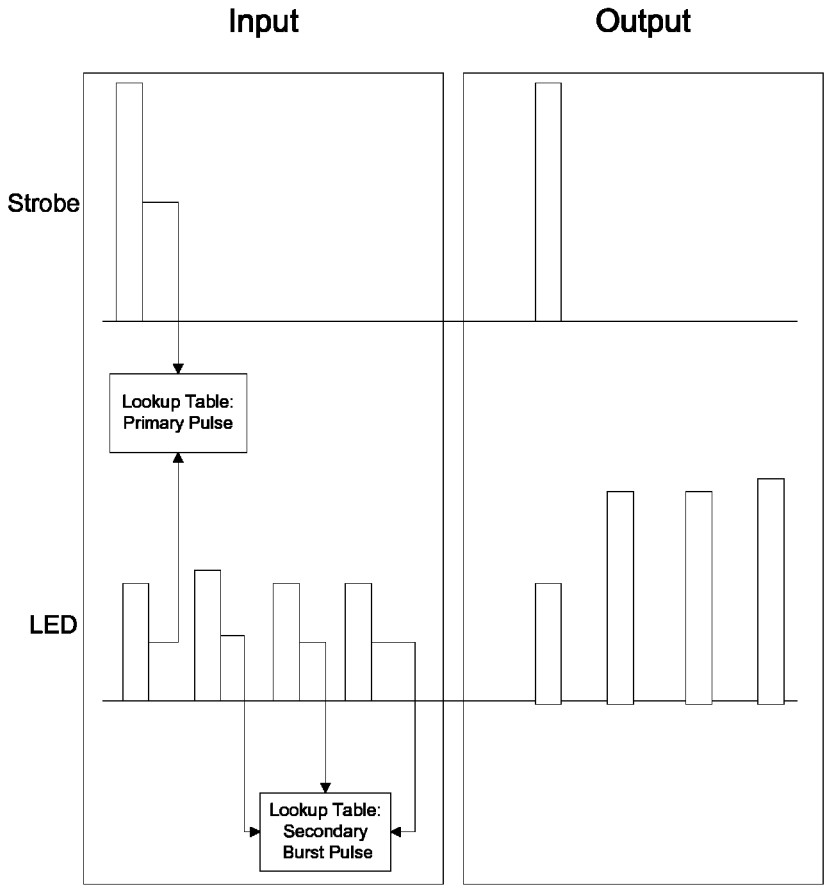
FIGS. 5-6 are graphical depictions of implementations of a method for amplitude range normalization.
Figure 6:
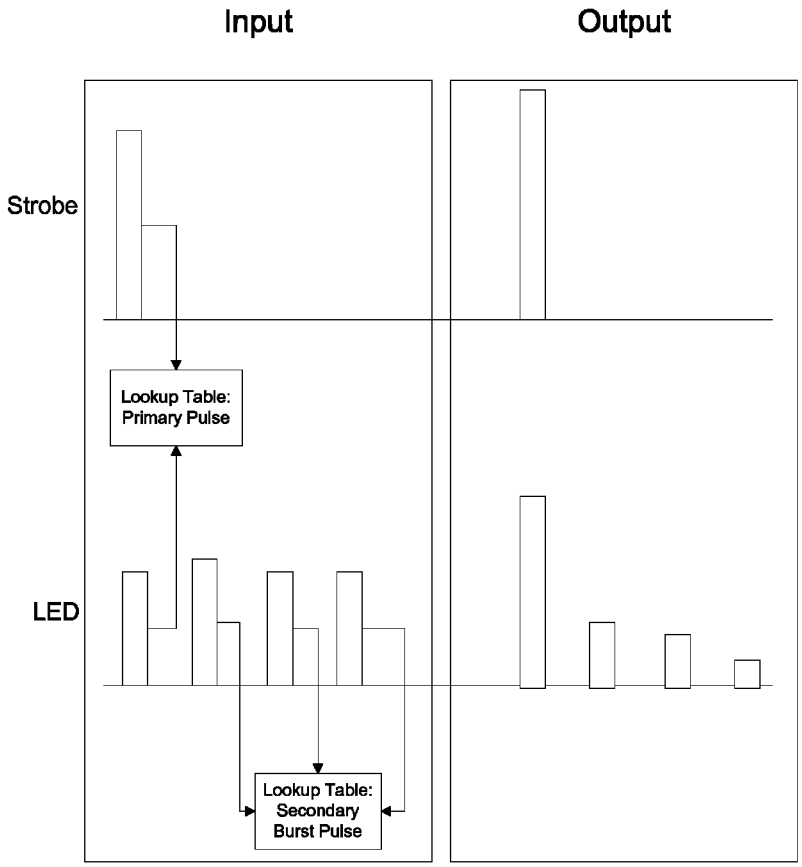

FIGS. 5-6 graphically depict an implementation of the disclosed methods. For the strobe emitter, the output waveform may be derived from a primary pulse lookup table whereas for the LED emitter, only the first pulse in the burst is derived from the primary pulse lookup table. All following pulses in the burst of the LED emitter are derived from a secondary lookup table that serves to normalize the range of the LED emitter to the target. FIG. 5 shows an example in which the emitters are at close range, resulting in the LED pulse amplitudes being amplified on the output of the emitter. By contrast, FIG. 6 shows the emitters being in close range and the LED pulse amplitudes are then attenuated on the output.

Generation of the amplitude range curves may be done via actual data collection. The emitter types in question (strobe and LED as in the example here) may be placed at specific ranges from the detector and data collection performed. In some types of detectors, the data collection comprises collecting voltage levels at a few places in the circuitry. These voltages are sampled and used for the range curve addressing. This data may be collected for each emitter type at a variety of specific ranges.

Two range curves may then be generated. The first is the range curve for the strobe emitter (or any other type of single pulse type emitter). This is accomplished by mapping the input voltages to output waveforms that achieve the desired range values as seen at the intersection. The second range curve may be a modification table that is applied to the output waveform for the LED emitter. Successive pulses in the LED emitter burst will modify the output such that the range as seen at the intersection is similar to that of a strobe emitter at the same distance.

In some embodiments, the output waveform may be generated by calculating the impulse response of a finite impulse response (FIR) filter from an input amplitude and modulating this on to an output function. While varying the amplitude of the input to the system is one method of varying the output waveform, other methods are also possible such as adaptively modifying the FIR filter taps.

In some implementations, other pulse burst timings may be used to signal a new emitter type to transform. Other properties of the detected pulses may also be used, including pulse widths, rise times, or pulse shapes in general. Some embodiments may also incorporate a buffering of the signal before producing any output waveforms. This allows the detector to perform some actual signal decoding which may be beneficial as range mappings may also be specific to select devices, such as a specific coded signal or band.

Because event processing is done at least partially on the detector itself, additional information may be sent along with the original pulse waveforms. As an example, a short pulse following the main signal pulses may convey additional information. The timing or amplitude of this pulse may be modified to provide some form of data encoding. In one particular example, a successive pulse may follow the main signal pulses but be delayed from 10 to 80 microseconds. Accordingly, this delay itself could represent a byte (1 to 8 value).

Intersections equipped with adequate memory may also store statistical information for various emitters to be used for future traffic preemptions or alternatively, this information may be stored at some other remote location that is in communication with the intersection.

In places where the description above refers to particular implementations of traffic preemption systems, it should be readily apparent that a number of modifications may be made without departing from the spirit thereof and that these implementations may be applied to other traffic preemption systems.

The invention claimed is:

1. A traffic preemption system comprising:

a vehicle preemption unit configured to mount to a vehicle and transmit a signal comprising one or more identifying pulses;

a detection unit configured to:

receive the signal transmitted by the vehicle preemption unit;

identify a characteristic of the vehicle preemption unit using the one or more identifying pulses; and calculate a timing delay based on the identified characteristic of the vehicle preemption unit; and an intersection preemption unit configured to:

receive the timing delay from the detection unit; and change a traffic light in response to the timing delay, wherein the characteristic of the vehicle preemption unit identified comprises at least one of a model and a manufacturer of the vehicle preemption unit.

2. The traffic preemption system of claim 1, wherein the vehicle preemption unit comprises at least one of a strobe emitter and an LED emitter.

3. The traffic preemption system of claim 1, wherein the one or more identifying pulses comprises a pulse pattern.

4. The traffic preemption system of claim 1, wherein the vehicle preemption unit is further configured to transmit a predetermined pulse pattern based on a priori information about a characteristic of the vehicle preemption unit.

5. A traffic preemption system comprising:

a vehicle preemption unit configured to mount to a vehicle and transmit a signal comprising one or more identifying pulses;

a detection unit configured to:

receive the signal transmitted by the vehicle preemption unit;

identify a characteristic of the vehicle preemption unit using the one or more identifying pulses; and calculate a timing delay based on the identified characteristic of the vehicle preemption unit; and an intersection preemption unit configured to:

receive the timing delay from the detection unit; and change a traffic light in response to the timing delay, wherein the vehicle preemption unit further comprises an output signal power detector configured to measure a signal strength of the signal transmitted by the vehicle preemption unit.

6. The traffic preemption system of claim 5, wherein the characteristic of the vehicle preemption unit identified comprises the signal strength of the signal transmitted by the vehicle preemption unit.

7. A traffic preemption system comprising:

a vehicle preemption unit configured to mount to a vehicle and transmit a signal comprising one or more identifying pulses;

a detection unit configured to:

receive the signal transmitted by the vehicle preemption unit;

identify a characteristic of the vehicle preemption unit using the one or more identifying pulses; and calculate a trip point based on the identified characteristic of the vehicle preemption unit and an estimated speed of the vehicle; and an intersection preemption unit configured to:

receive the trip point from the detection unit; and change a traffic light in response to the trip point received, wherein the characteristic of the vehicle preemption unit identified comprises at least one of a model and a manufacturer of the vehicle preemption unit and the detection unit is further configured to normalize a pulse amplitude of the signal received from the vehicle preemption unit based on the characteristic of the vehicle preemption unit that is identified.

8. The traffic preemption system of claim 7, wherein the detection unit is further configured to determine an amplitude of the signal transmitted by the vehicle preemption unit by sampling the incoming signal and determining an average pulse amplitude or by determining a width of a detection envelope for the incoming signal.

9. A traffic preemption system comprising:

a vehicle preemption unit configured to mount to a vehicle and transmit a signal comprising one or more identifying pulses;

a detection unit configured to:

receive the signal transmitted by the vehicle preemption unit;

identify a characteristic of the vehicle preemption unit using the one or more identifying pulses; and calculate a trip point based on the identified characteristic of the vehicle preemption unit and an estimated speed of the vehicle; and an intersection preemption unit configured to:

receive the trip point from the detection unit; and change a traffic light in response to the trip point received, wherein the vehicle preemption unit further comprises an output signal power detector configured to measure a signal strength of the signal transmitted by the vehicle preemption unit.

10. The traffic preemption system of claim 9, wherein the characteristic of the vehicle preemption unit identified comprises the signal strength of the signal transmitted by the vehicle preemption unit.

11. The traffic preemption system of claim 7, wherein the vehicle preemption unit is further configured to transmit a suppression signal to the detection unit and the intersection preemption unit is further configured to prevent a change in a traffic light in response to the suppression signal received from the detection unit.

12. A traffic preemption method comprising:

transmitting a signal comprising one or more identifying pulses by a vehicle preemption unit mounted to a vehicle;

receiving the signal by a detection unit;

identifying, by the detection unit, a characteristic of the vehicle preemption unit using the one or more identifying pulses;

adjusting, by the detection unit, an amplitude of a signal output by the detection unit based on the identified characteristic of the vehicle preemption unit;

receiving, by an intersection preemption unit, the amplitude-adjusted signal output from the detection unit; and changing, by the intersection preemption unit, a traffic light in response to the amplitude-adjusted signal received by the intersection preemption unit, wherein the characteristic of the vehicle preemption unit identified comprises at least one of a model and a manufacturer of the vehicle preemption unit and the method further comprises normalizing a pulse amplitude of the signal received from the vehicle preemption unit based on the characteristic of the vehicle preemption unit that is identified.

13. The traffic preemption method of claim 12, wherein the one or more identifying pulses comprises a pulse pattern.

14. The traffic preemption method of claim 12, further comprising determining, by the detection unit, an amplitude of the signal transmitted by the vehicle preemption unit by sampling the incoming signal and determining an average pulse amplitude or by determining a width of a detection envelope for the incoming signal.

15. The traffic preemption method of claim 12, further comprising transmitting, by the vehicle preemption unit, a predetermined pulse pattern based on a priori information about a characteristic of the vehicle preemption unit.

16. A traffic preemption method comprising:

transmitting a signal comprising one or more identifying pulses by a vehicle preemption unit mounted to a vehicle;

receiving the signal by a detection unit;

measuring, by an output signal power detector of the vehicle preemption unit, a signal strength of the signal transmitted by the vehicle preemption unit;

identifying, by the detection unit, a characteristic of the vehicle preemption unit using the one or more identifying pulses;

adjusting, by the detection unit, an amplitude of a signal output by the detection unit based on the identified characteristic of the vehicle preemption unit;

receiving, by an intersection preemption unit, the amplitude-adjusted signal output from the detection unit; and changing, by the intersection preemption unit, a traffic light in response to the amplitude-adjusted signal received by the intersection preemption unit.

17. The traffic preemption method of claim 16, wherein the characteristic of the vehicle preemption unit identified comprises the signal strength of the signal transmitted by the vehicle preemption unit.

18. The traffic preemption system of claim 5, wherein the vehicle preemption unit comprises at least one of a strobe emitter and an LED emitter.

19. The traffic preemption system of claim 5, wherein the one or more identifying pulses comprises a pulse pattern.

20. The traffic preemption system of claim 5, wherein the vehicle preemption unit is further configured to transmit a predetermined pulse pattern based on a priori information about a characteristic of the vehicle preemption unit.

21. The traffic preemption system of claim 9, wherein the detection unit is further configured to determine an amplitude of the signal transmitted by the vehicle preemption unit by sampling the incoming signal and determining an average pulse amplitude or by determining a width of a detection envelope for the incoming signal.

22. The traffic preemption system of claim 9, wherein the vehicle preemption unit is further configured to transmit a suppression signal to the detection unit and the intersection preemption unit is further configured to prevent a change in a traffic light in response to the suppression signal received from the detection unit.

23. The traffic preemption method of claim 16, wherein the one or more identifying pulses comprises a pulse pattern.

24. The traffic preemption method of claim 16, further comprising determining, by the detection unit, an amplitude of the signal transmitted by the vehicle preemption unit by sampling the incoming signal and determining an average pulse amplitude or by determining a width of a detection envelope for the incoming signal.

25. The traffic preemption method of claim 16, further comprising transmitting, by the vehicle preemption unit, a predetermined pulse pattern based on a priori information about a characteristic of the vehicle preemption unit.

* * * * *